US006782668B2

(12) United States Patent
Bruce

(10) Patent No.: US 6,782,668 B2
(45) Date of Patent: Aug. 31, 2004

(54) ROOF-SCREEN SYSTEM

(76) Inventor: Ryan W. Bruce, 360 D Coral St., Santa Cruz, CA (US) 95060

( * ) Notice: Subject to any disclaimer, the term of this patent is extended or adjusted under 35 U.S.C. 154(b) by 48 days.

(21) Appl. No.: 09/902,865

(22) Filed: Jul. 10, 2001

(65) Prior Publication Data

US 2003/0009959 A1 Jan. 16, 2003

(51) Int. Cl.[7] ..... E04H 12/20

(52) U.S. Cl. ..... 52/147; 52/146; 52/710; 52/127.2; 135/94; 248/351; 256/12.5

(58) Field of Search ..... 52/146, 147, 127.2, 52/710, 712–713; 135/91, 95, 94; 248/59, 62, 74.1–74.4, 351; 256/12.5; 403/52, 56, 57, 65, 330, 344

(56) References Cited

U.S. PATENT DOCUMENTS 3,817,006 A * 6/1974 Williams ..... 52/122
D243,853 S * 3/1977 Ejchorszt ..... D25/43
4,083,156 A * 4/1978 Tye ..... 52/127
4,872,634 A * 10/1989 Gillaspy et al. ..... 248/354.3
5,622,021 A * 4/1997 Bookout ..... 52/582.1
5,862,637 A * 1/1999 Bruce ..... 52/147
5,943,830 A * 8/1999 Truitt ..... 52/127.2
6,205,719 B1 * 3/2001 Bruce ..... 52/147

* cited by examiner

*Primary Examiner*—Carl D Friedman
*Assistant Examiner*—Yvonne M. Horton
(74) *Attorney, Agent, or Firm*—Thomas Schneck; Gina McCarthy

(57) ABSTRACT

A roof-screen system for supporting a roof screen on a roof, comprises a plurality of frame elements of round galvanized steel tubing configured as separate frames. The frames have a front element, a bottom element, and a diagonal brace element. A plurality of base supports are secured to the frame elements and sleeve connectors, including a base connector, an end connector, and a field connector which secure the frame elements together and to the base. A plurality of support elements are used for supporting the face panels to the front element of the separate frames.

40 Claims, 3 Drawing Sheets

ROOF-SCREEN SYSTEM

BACKGROUND OF THE INVENTION

1. Field of Invention

This invention relates to roof screens for use on the roof of a building for hiding or screening the roof top equipment such as air conditioners, ventilation equipment, pipes, electrical boxes, and more particularly to roof screens which are elevated on frames and base supports.

2. Description of the Related Art

Various roof screens have been proposed and implemented to hide or screen roof top equipment such as air conditioners, ventilation equipment, pipes, electrical boxes and the like. Such screens are also called mechanical screen walls, equipment screens, site screens, or screen walls. Traditional installations have used wooden "sleepers" bolted into the roof and wooden or sheet metal stud frames built on top of the wood sleepers. The panels usually used are either plywood or corrugated metal. A significant limitation of such systems is that the bolting of the sleepers through the roof causes roof leaks and damage.

Various methods and apparatuses have been proposed to improve on such systems. U.S. Pat. No. 5,862,637 issued Jan. 26, 1999 to Bruce, the inventor of the present invention, disclosed a steel system that is supported by round steel posts. This system greatly improved on the method of attachment to a roof, allowing watertight integrity of the attachment to the roof to be maintained. Such system used a heavy steel angle iron which was custom fit and welded in the field during installation.

Another patent issued to the present inventor, U.S. Pat. No. 6,205,719, issued to Bruce Mar. 27, 2001, disclosed a system which eliminates the field welding requirement. Such system used aluminum components which were adjustable in the field for a custom fit to the roof. Such system is very expensive to manufacture, and is vulnerable to vandalism for the recyclable aluminum. Such type of system is not as strong as the steel system, and has been limited by its expense.

Accordingly, it is the primary object of this invention to provide a roof screen system which is easy to install, inexpensive to manufacture, which may be manufactured and installed more quickly than any prior system, and does not face the risk of vandalism inherent in the aluminum systems.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, a roof-screen system is provided including frame tubes of galvanized steel tubing. The tubing is configured in separate frames having a horizontal base, a vertical support, and a diagonal brace. These frames are preferably spaced according to the on-center spacing of the structural member of the roof framing system. The system is supported by steel "T" shaped base supports that are bolted into the structural frame elements. The frame tubes are held together by sliding sleeve connectors including, base connectors, end connectors and field connectors that telescope over the tube members. These sleeve connectors connect the frame tubes together while allowing adjustment in any direction during installation. Hat sections are installed horizontally across the series of frames, usually in two or three rows depending on wind loads and the height of the wall. The hat sections provide a mounting surface for the installation of the face panels.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention, a roof-screen system for supporting a roof screen on a roof, having a plurality of frame elements of round galvanized steel tubing configured as separate frames. The frames have a front element, a bottom element, and a diagonal brace element. A plurality of base supports are secured to the frame elements, and sleeve connectors, including a base connector, an end connector, and a field connector which secure the frame elements together and to the base. A plurality of support elements are used for supporting the face panels to the front element of the separate frames.

Figure 1:
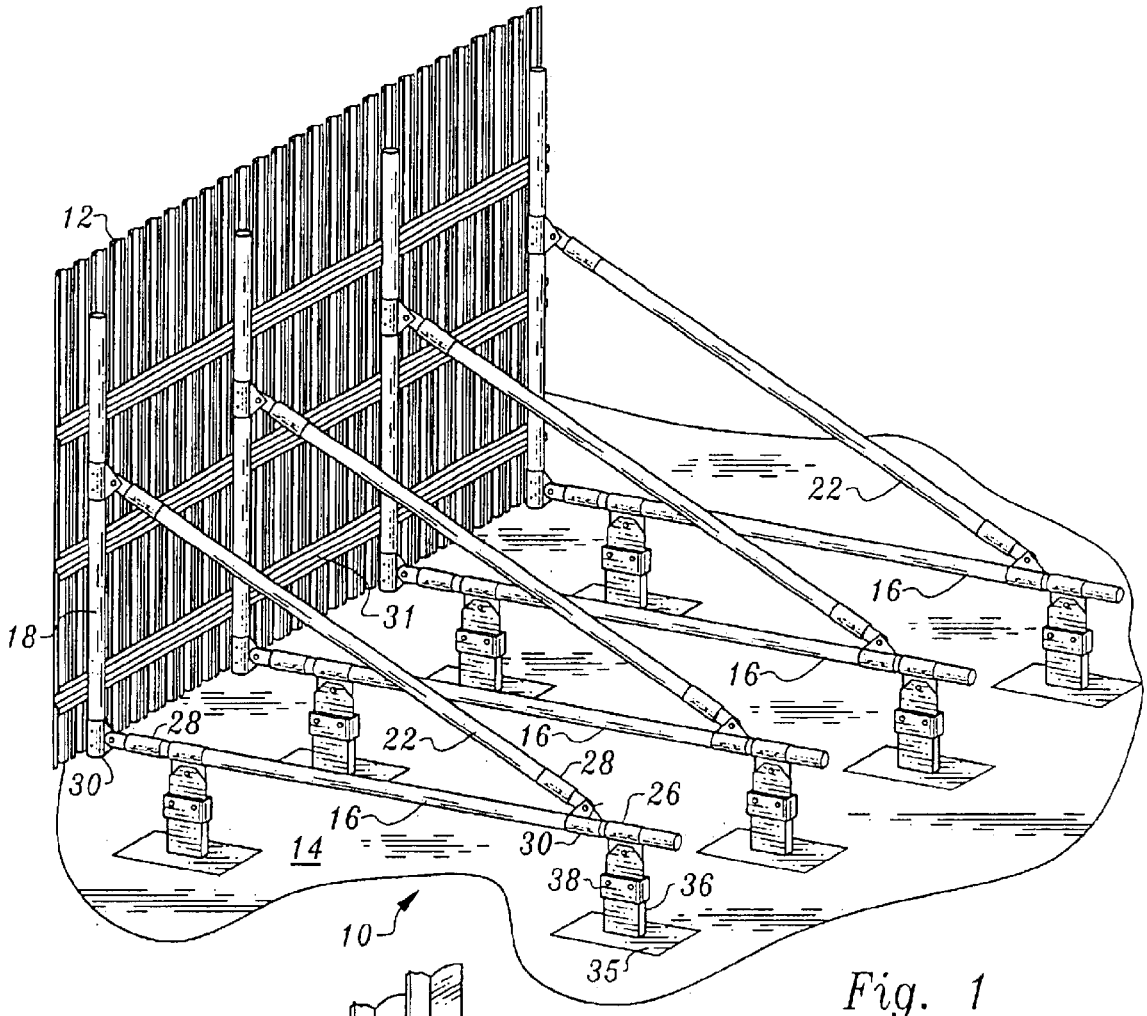
FIG. 1 is a perspective view a roof screen system, according to the invention.

In FIG. 1, the roof-screen system 10, is shown according to a preferred embodiment of the invention. Roof-screen system 10, for supporting a roof screen 12, on a roof 14, comprises a plurality of frame elements 16, preferably composed of round galvanized steel tubing, or other durable resilient material. The plurality of frame elements are configured as separate frames each having a front element 18, a bottom element 20, and a diagonal brace element 22.

Figure 2:
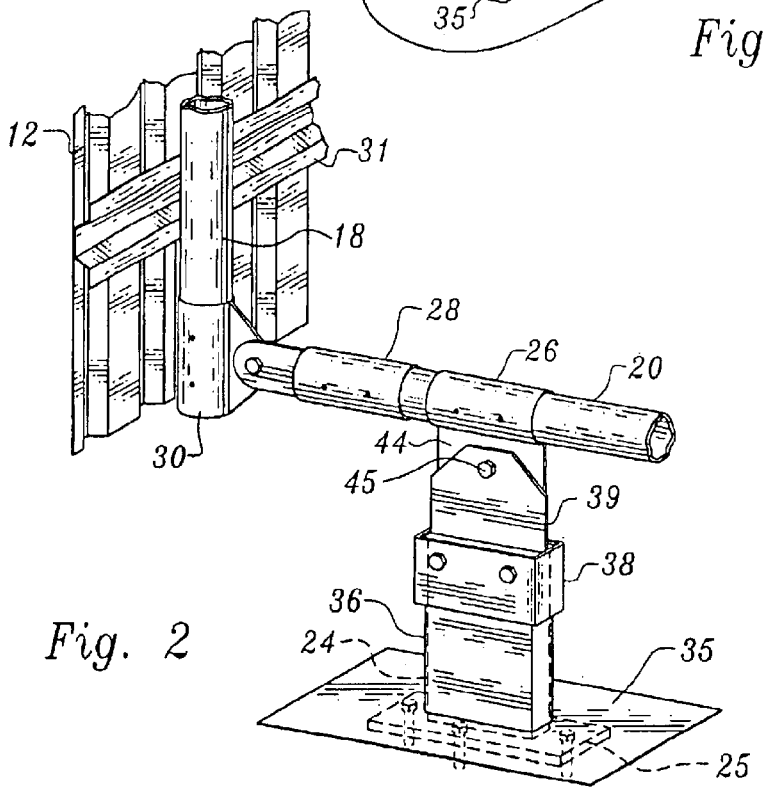
FIG. 2 is a view of a base support with a bottom element and front element secured thereto, according to the invention.

A plurality of base supports 24, are operably secured to the bottom frame elements 20, as seen in FIGS. 1 and 2.

Sleeve connector means which preferably are base connectors 26, end connectors 28, and field connectors 30, are used to connect the plurality of frame elements together and the base supports together.

A plurality of support means, preferably hat sections 31, which are elongated rail supports, are used to provide a mounting surface for face panels of roof screen 12. Preferably hat sections 31, are installed horizontally across the plurality of frames, typically using two or three rows depending on wind loads and the height of the wall, and may be screwed or bolted or otherwise affixed to front frame element 18. The face panels 12, may be provided in a variety of styles, colors, and finishes as desired, and may be varied to meet wind loads and attachment methods.

Figure 3:
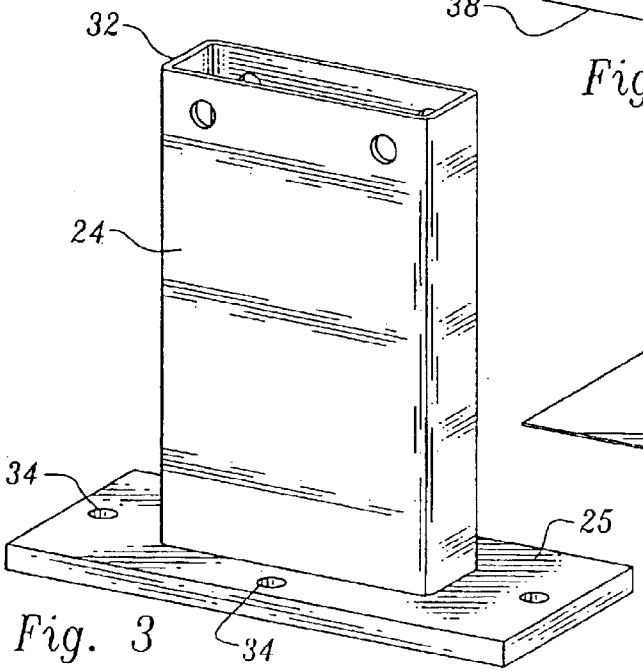
FIG. 3, is a view of a base support, according to the invention.

With reference now to FIG. 3, base support 24 is shown, and is preferably composed of steel. Rectangular shaped tube 32 may be welded to base plate 25 or other fastening means. The thickness and dimensions of base support 24 may be changed depending upon wind loads and particular site features, as may be the particular placing and spacing of bolt holes 34.

Figure 4:
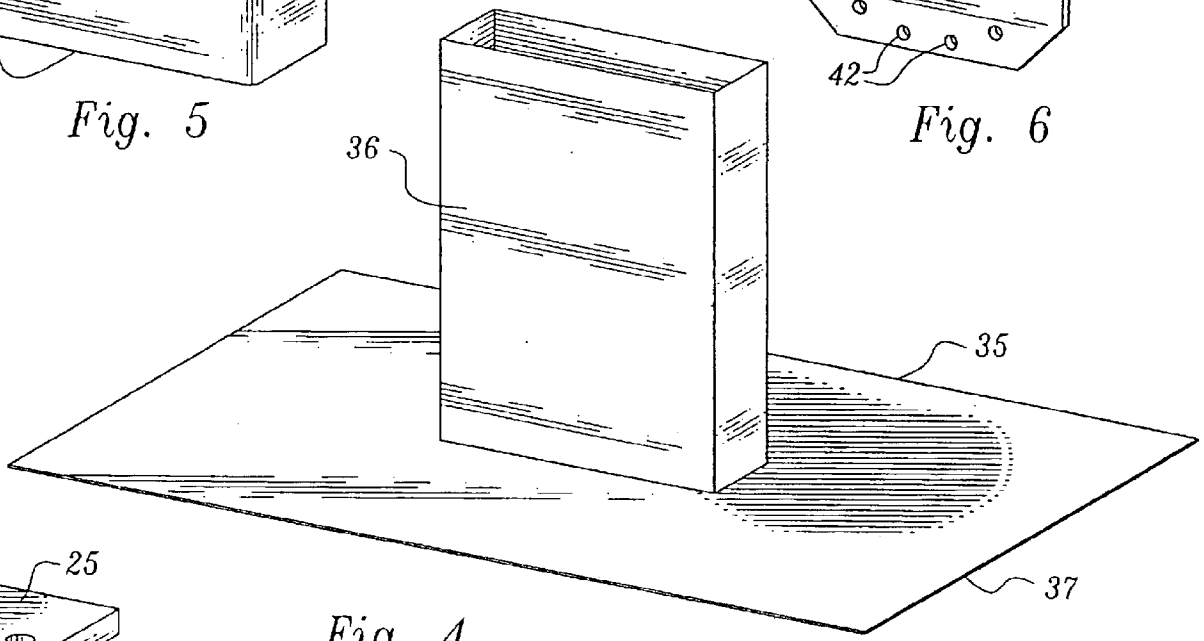
FIG. 4, is a view of a base flashing, according to the invention.

In FIG. 4, base flashing 35 with riser 36 and base 37 is shown. The inside dimension of riser 36 is slightly larger than the outside dimension of rectangular tube 32 of the base support 24. Base 37 is preferably about 4 inches larger than the base plate 25 of base support 24, but may be provided in other sizes as well. Base flashing 35 is slipped over base support 24, preferably after base support 24 is installed and bolted to the roof. Base flashing 35 provides weather protection and is preferred, however, it may be omitted in alternative embodiments.

Figure 6:
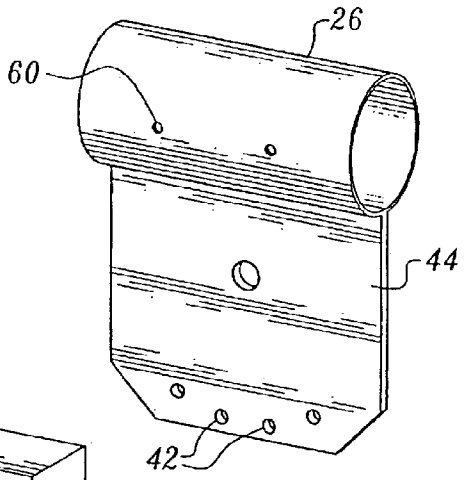
FIG. 6 is a view of a base connector sleeve, according to the invention.
Figure 5:
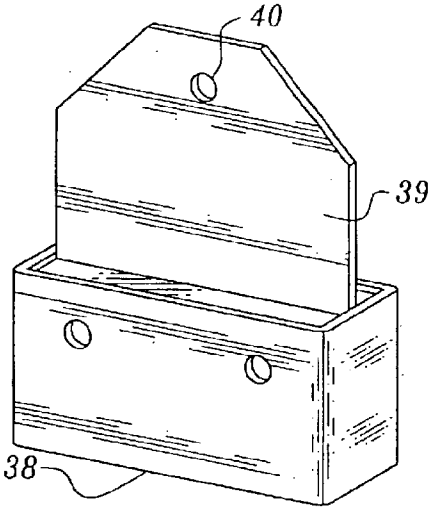
FIG. 5 is a view of a base cap, according to the invention.

As seen in FIG. 5, base cap 38 is preferably composed of steel or other durable material, and is sized to slip over base support 24 and base flashing 35, so as to provide weather protection for the top of base flashing 35 as well as a mounting bracket for base connector 26, seen in FIG. 6. Preferably, the body of base cap 38 is fabricated from a piece of rectangular tubing large enough to telescope over riser 32, on base support 24, but leaving enough clearance for base flashing 35 between base support 24 and base cap 38. Base cap 38 preferably counter-flashes over base support 24 and base flashing 35 allowing holes in base cap 38 to align with holes in base support 24 to receive bolts that extend through base cap 38 and base support 24. Preferably the main body of base cap 38 has a welded plate, forming a water tight end cap and providing a welding surface for fin plate 39, which is the bracket for mounting base connector 26. Fin plate 39, may be provided with pre-punched holes for pivot bolt 40, so as to allow base connector 26 to pivot in conditions where the base supports 24 are not perpendicular to frame elements 16. Preferably the corners of fin plate 39 are beveled to allow for clearance of base connector 26 in conditions where it must pivot.

With reference now to FIG. 6, base connector 26 is shown, preferably including a tubing with fin plate 44 welded thereto. The tubing is sized to telescope over frame elements 16, allowing for unlimited adjustments during installation. Base connector 26 is preferably composed of steel or other durable material and may include pre-punched pilot holes 60 to receive screws, such as self drilling tek type screws. After field adjustments are made by sliding base connectors 26 on frame elements 16 as necessary, the screws are installed, ultimately providing a permanent connection between base connector 26 and frame elements 16. Preferably, fin plate 44 is provided with pre-punched holes to receive the pivot bolt 45, that secures base cap 38 to base connector 26. Fin plate 44, may be provided with pre-punched holes 42 arranged at a radius from the center of the pivot bolt, or otherwise as desired. These holes guide screws to secure fin 39 of base cap 38, to fin 44 of base connector 26 after pivoting adjustments have been made, so as to provide a fixed connection between base supports 24 and bottom frame tube 20.

Figure 7:
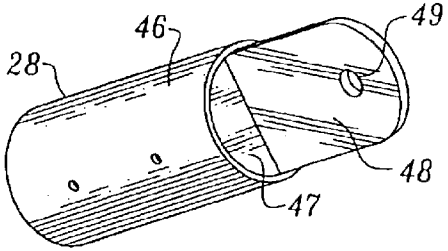
FIG. 7 is a view of an end connector, according to the invention.

In FIG. 7, end connector 28 is shown with tube 46 sized to telescope over the frame elements and end cap 47, preferably welded to tube 46 to provide a welding surface for fin arm 48. Fin arm 48 is preferably provided with a pre-punched aperture 49 for a pivot bolt. End connector 28 is installed on the end of a frame element to provide means of connecting the end of the frame element to a field connector 30. Aperture 49, in the fin arm of end connector 28 is aligned with the aperture in the fin of field connector 30 and preferably is secured by a pivot bolt. Tube 46 of end connector 28 may be provided with pre-punched apertures to receive screws. After field adjustments are made by twisting the end connectors on the frame elements 16 as necessary, the screws are installed, providing a permanent connection between the end connectors 28 and the frame elements 16.

Figure 8:
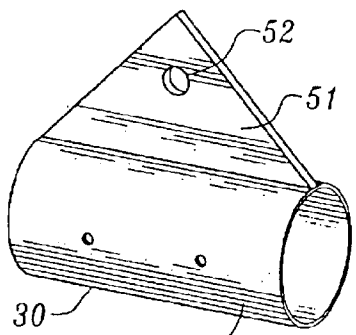
FIG. 8 is a view of a field connector, according to the invention.

With reference now to FIG. 8, field connector 30 is shown with tube portion 50, fin 51, and aperture 52 for a pivot bolt. Tube portion 50, is preferably sized to telescope over the frame tubing allowing for unlimited adjustments during installation, and may be provided with pre-punched apertures to received securing screws or bolts. After field adjustments have been made by sliding field connectors 30 on the frame tubes as necessary, screws are installed providing for a permanent connection between the field connector and the frame tube. Fin 51 may also be provided with aperture 52 for a pivot bolt that mates field connector 30 with end connector 28.

Figure 9:
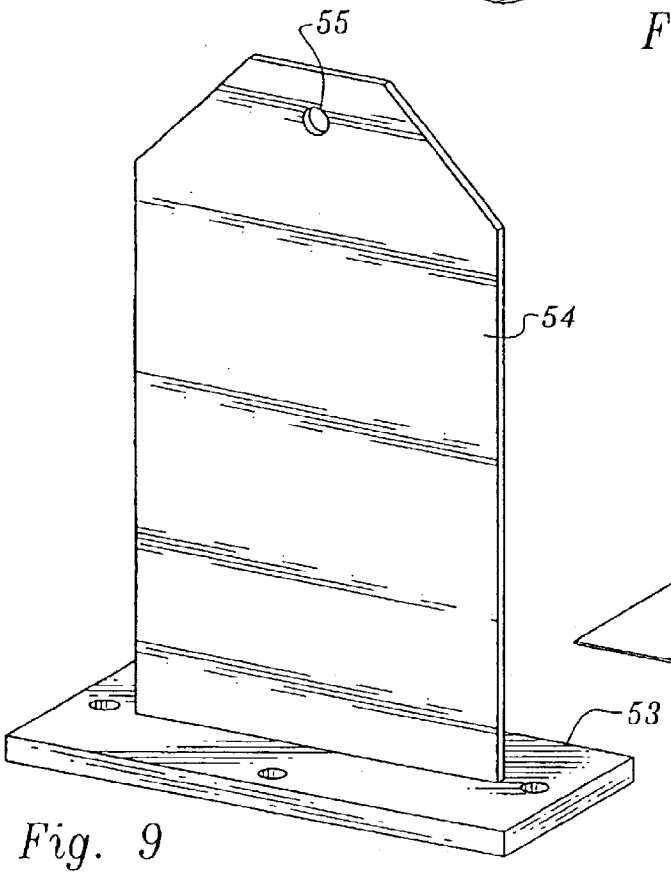
FIG. 9 is a view of an alternative embodiment of a base support, according to the invention.

In FIG. 9, an alternative embodiment of a base support is shown. Base support 53 comprises a rectangular plate 54 preferably welded to a flat base plate with aperture 55 for receiving a pivot bolt. The thickness and dimensions of this base support may be varied depending upon wind loads and installation environment.

Figure 10:
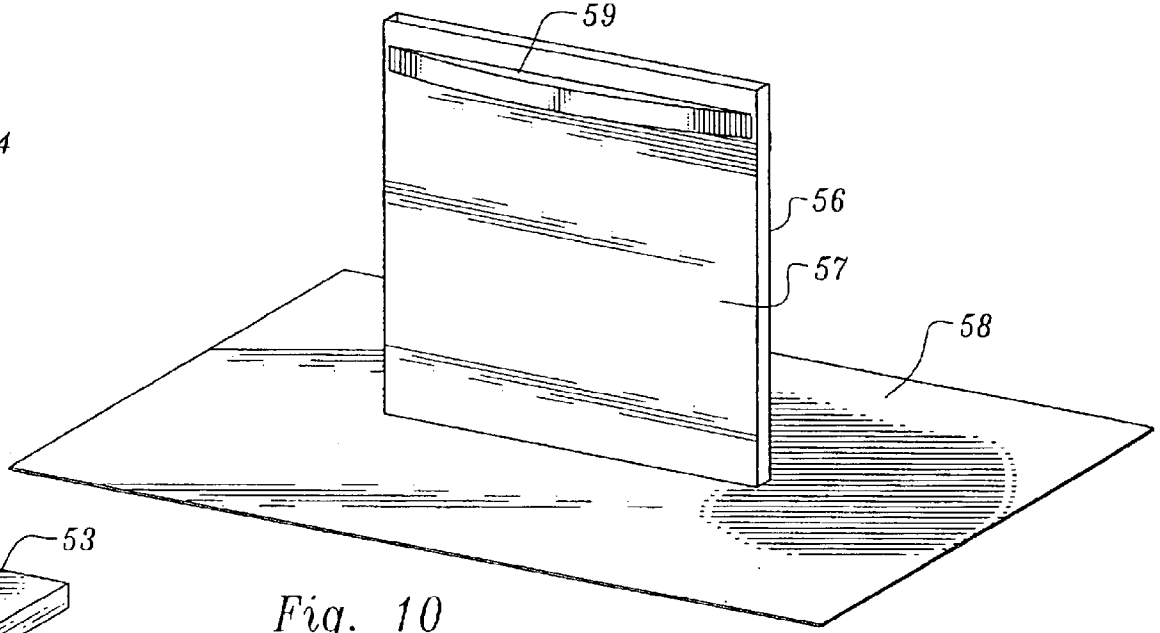
FIG. 10 is an alternative embodiment of a base flashing, according to the invention.

In FIG. 10, an alternative embodiment of the base flashing is shown. Base flashing 56 is provided with a rectangular riser 57 preferably soldered to a flat base 58. In this embodiment, the base flashing is preferably composed of a soft lead or similar material. The base flashing slips over the base support after the base support is installed and bolted to the roof. At the upper portion of riser 57, are radius wedges 59, soldered to riser 57. These wedges provide a surface for a clamping band to tighten around the base flashing drawing the soft lead tightly to the steel plate riser of the base support.

In operation and use, the roof-screen system of the present invention is easy and quick to install, reliable, efficient, is less expensive to manufacture than prior systems, and may use material that is less at risk of vandalism than prior systems.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A roof-screen system for supporting a roof screen on a roof, comprising:

a frame including a front element, a bottom element, and a diagonal element;

a base support;

a connector having a telescoping element which telescopes over said bottom element and means for connecting said telescoping element to said base support which means is in fixed relation with said telescoping element;

sleeve connector means for connecting said front, bottom and diagonal elements; and a support means for supporting a face panel to said front element.

2. The roof-screen system of claim 1 wherein said telescoping element is tubular.

3. The roof-screen assembly of claim 1 wherein said telescoping element is in fixed relation with said base support.

4. The roof-screen assembly of claim 1 wherein means for connecting said telescoping element to said base support is in fixed relation with said base support.

5. The roof-screen assembly of claim 1 wherein said frame elements are steel.

6. The roof-screen assembly of claim 1 wherein said frame elements are tubular.

7. The roof screen assembly of claim 1 wherein said frame elements are round galvanized steel tubing.

8. The roof screen assembly of claim 1 wherein said frame elements form a triangular frame.

9. The roof-screen assembly of claim 1 wherein said base support is operably secured to a roof.

10. The roof-screen assembly of claim 1 wherein said support means is horizontally positioned.

11. A roof-screen system for supporting a roof screen on a roof, comprising:

a frame including a front element, a bottom element, and a diagonal element;

a base support;

a connector having a telescoping element which telescopes over said bottom element and a plate extending from said telescoping element, said plate being connectable to said base support;

sleeve connector means for connecting said front, bottom and diagonal elements; and a support means for supporting a face panel to said front element.

12. The roof-screen assembly of claim 11 wherein said plate is welded to said telescoping element.

13. The roof-screen system of claim 11 wherein said telescoping element is tubular.

14. The roof-screen assembly of claim 11 wherein said plate is in fixed relation with said telescoping element.

15. The roof-screen assembly of claim 11 wherein said plate is in fixed relation with said base support.

16. The roof-screen assembly of claim 11 wherein said telescoping element is in fixed relation with said base support.

17. The roof screen assembly of claim 11 wherein said plate includes a hole for connecting said connector to said base support.

18. The roof-screen assembly of claim 11 wherein said frame elements are steel.

19. The roof-screen assembly of claim 11 wherein said frame elements are tubular.

20. The roof screen assembly of claim 11 wherein said frame elements are round galvanized steel tubing.

21. The roof screen assembly of claim 11 wherein said frame elements form a triangular frame.

22. The roof-screen assembly of claim 11 wherein said base support is operably secured to a roof.

23. The roof-screen assembly of claim 11 wherein said support means is horizontally positioned.

24. The roof-screen assembly of claim 11 wherein said plate is connectable to said base support by a base cap telescoping over said base support and a second plate extending from said base cap, said plate and said second plate being securable to one another to connect said bottom element and said base support.

25. The roof-screen assembly of claim 24 wherein said two plates are in fixed relation to one another.

26. A roof-screen system for supporting a roof screen on a roof, comprising:

a frame including a front element, a bottom element, and a diagonal element;

a base support operably secured to said bottom element;

connector means including a first connector having a first telescoping element telescoping over one of said frame elements and a first plate extending from said first telescoping element and a second connector having a second telescoping element telescoping over another of said frame elements and a second plate extending from said second telescoping element, said first and second plates being securable to one another to connect one of said frame elements and the other of said frame elements; and a support means for supporting a face panel to said front element.

27. The roof-screen system of claim 26 wherein one of said frame elements is said front element and the other of said frame elements is said bottom element.

28. The roof-screen system of claim 26 wherein one of said frame elements is said front element and the other of said frame elements is said diagonal element.

29. The roof-screen system of claim 26 wherein one of said frame elements is said diagonal element and the other of said frame elements is said bottom element.

30. The roof screen assembly of claim 26 wherein said first and second plates are in fixed relation with said first and second telescoping elements, respectively.

31. The roof-screen assembly of claim 26 wherein said first and second plates are welded to said first and second telescoping elements, respectively.

32. The roof-screen assembly of claim 26 wherein said first plate includes a first hole and said second plate includes a second hole, said first and second holes alignable for securing said first and second plates.

33. The roof screen system of claim 26 wherein said first and second telescoping elements are tubular.

34. The roof screen assembly of claim 26 wherein said frame elements form a triangular frame.

35. The roof-screen assembly of claim 26 wherein said base support is operably secured to a roof.

36. The roof-screen assembly of claim 26 wherein said support means is horizontally positioned.

37. The roof-screen assembly of claim 26 wherein said frame elements are steel.

38. The roof-screen assembly of claim 26 wherein said frame elements are tubular.

39. The roof screen assembly of claim 26 wherein said frame elements are round galvanized steel tubing.

40. A roof-screen system for supporting a roof screen on a roof, comprising:

a frame including a front element, a bottom element, and a diagonal element;

a base support;

a connector having a telescoping element which telescopes over said bottom element and means for connecting said telescoping element to said base support which means is in fixed relation with said telescoping element, wherein said means for connecting said telescoping element to said base support is welded to said telescoping element;

sleeve connector means for connecting said front, bottom and diagonal elements; and a support means for supporting a face panel to said front element.

* * * * *